US005893273A

United States Patent [19]

Casiraghi

[11] Patent Number: 5,893,273

[45] Date of Patent: Apr. 13, 1999

[54] SHUT-OFF VALVE WITH INCORPORATED EXPANSION NOZZLE, FOR PRESSURIZED FLUIDS OF AIR COOLING/HEATING APPARATUS

[75] Inventor: Daniele Casiraghi, Fino Mornasco, Italy

[73] Assignee: Aeroquip Vickers, Inc., Maumee, Ohio

[21] Appl. No.: 08/877,338

[22] Filed: Jun. 17, 1997

[30] Foreign Application Priority Data

Jun. 21, 1996 [IT] Italy ..... MI96A1270

[51] Int. Cl.[6] ..... F25B 41/06

[52] U.S. Cl. ..... 62/511; 138/44

[58] Field of Search ..... 62/511, 527; 137/557; 138/44

[56] References Cited

U.S. PATENT DOCUMENTS

| | | | |
|---|---|---|---|
| 2,337,862 | 1/1943 | Baer . | |
| 2,676,470 | 4/1954 | Streitz . | |
| 2,712,458 | 7/1955 | Lipson | 138/44 |
| 2,936,790 | 5/1960 | Dahl et al. | 62/511 |
| 3,992,898 | 11/1976 | Duell et al. | 62/324 |
| 4,266,576 | 5/1981 | Bradford | 138/40 |
| 4,324,112 | 4/1982 | Fujiwara et al. | 62/511 |
| 4,412,431 | 11/1983 | Waldrep | 62/511 |
| 4,784,177 | 11/1988 | Sepso et al. | 137/513.3 |
| 4,909,277 | 3/1990 | Vandiver | 137/493.7 |
| 5,265,438 | 11/1993 | Knowles et al. | 62/324.6 |
| 5,454,233 | 10/1995 | Naujock | 62/511 |
| 5,507,468 | 4/1996 | Evans | 251/118 |

*Primary Examiner*—William E. Tapolcal
*Attorney, Agent, or Firm*—Herbert Dubno

[57] ABSTRACT

A shut-off valve for pressurized fluids in particular for air cooling/heating apparatus includes at least one condenser and at least one fluid evaporator communicating with each other by a pipe at least one duct which has inside a nozzle coaxially formed with a capillary duct designed to cause rapid expansion of the fluid when it emerges from the nozzle, and a retainer securing the pipe to the valve.

6 Claims, 3 Drawing Sheets

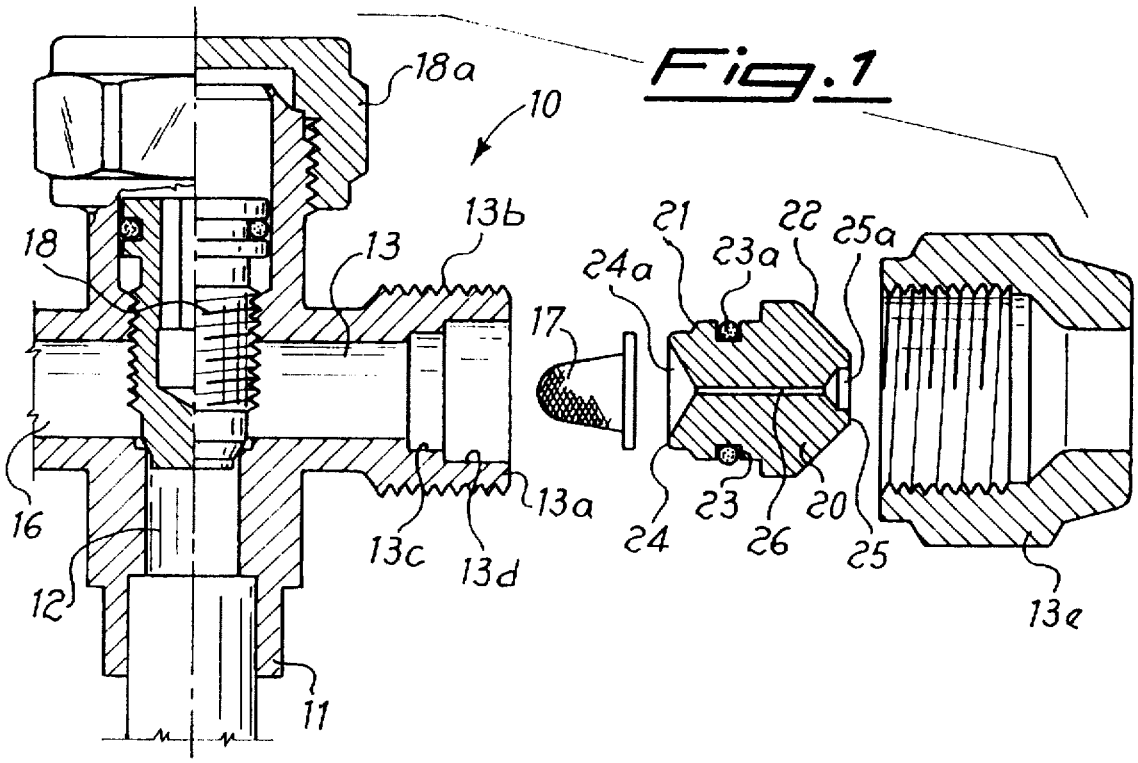
Fig. 1
Fig. 2
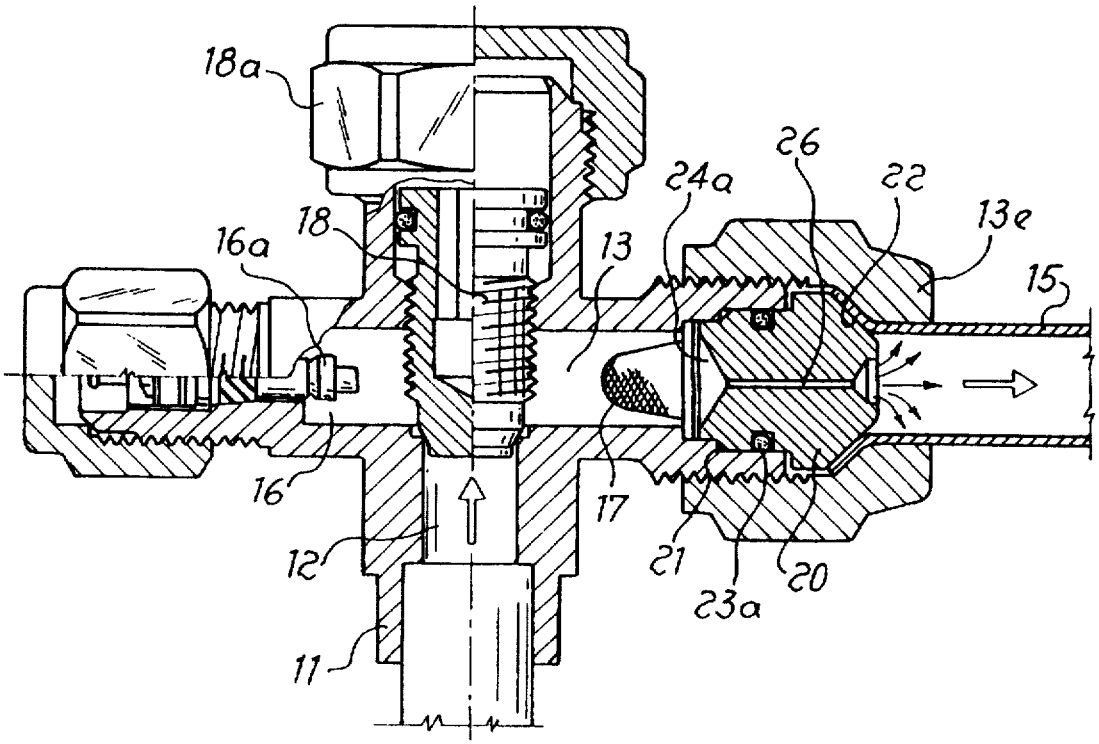

SHUT-OFF VALVE WITH INCORPORATED EXPANSION NOZZLE, FOR PRESSURIZED FLUIDS OF AIR COOLING/HEATING APPARATUS

FIELD OF THE INVENTION

The present invention relates to a shut-off valve for pressurised fluids of air cooling/heating apparatus such as conditioners and the like.

BACKGROUND OF THE INVENTION

It is known in the art of air conditioners of the need to cause circulation of the ambient air through two heat exchangers which form respectively the condenser and the evaporator of the refrigerating cycle.

It is also known that the condenser and the evaporator must be placed in communication with each another by means of shut-off valves and devices, such as for example thermostatic valves or capillaries designed to cause rapid expansion of the cooling fluid when the latter passes from one component to another.

The valves and expansion means are normally arranged inside the conditioner if the latter is of the conventional type with a single body; If the conditioner is of the type with a separate evaporator to be positioned inside the room, the valve is positioned outside and the expansion means inside the conditioner itself.

More particularly, expansion may be performed upstream of the shut-off valve, i.e. in the condenser, or downstream of the shut-off valve, i.e. in the evaporator.

Since the dimensioning of the means for expansion of the cooling fluid depends on the efficiency of the conditioner in relation to the different external temperatures, the technical problem which is posed is that of providing an expansion element which is accessible externally and easily interchangeable. The latter should be designed in accordance with the variation in the said external temperatures at which the air conditioner is used and the length of the pipes thereof, without the need for complex welding operations.

OBJECTS OF THE INVENTION

It is therefore a principle object of the present invention to provide a temperature regulating apparatus having an expansion element which can be easily replaced.

Another object is to provide the apparatus according the present invention having a standardized group of components parts, in particular an expansion means provided with a shut-off liquid valve.

Still another object of the present invention is to provide the apparatus provided with the standardized components parts utilized in a cooling cycle as well as in a heating cycle.

These results are achieved by the present invention, which envisages a shut-off valve for pressurised fluids in particular for air cooling/heating apparatus comprising at least one condenser and at least one fluid evaporator to be placed in communication by means of a pipe, wherein the valve comprises at least one duct which has arranged inside it a nozzle in which there is coaxially formed a capillary duct designed to cause rapid expansion of the fluid when the latter emerges from the nozzle, the nozzle being held in position by means for securing the said pipe to the valve.

BRIEF DESCRIPTION OF THE DRAWING

Further objects, features and details may be obtained from the following description of the invention, provided with reference to the accompanying drawings in which:

FIG. 1 shows a partially sectioned exploded view of the valve according to the present invention with the single-acting expansion element incorporated;

FIG. 2 shows a partially sectioned view of the valve with the expansion element, in the assembled condition;

SPECIFIC DESCRIPTION

Figure 3:
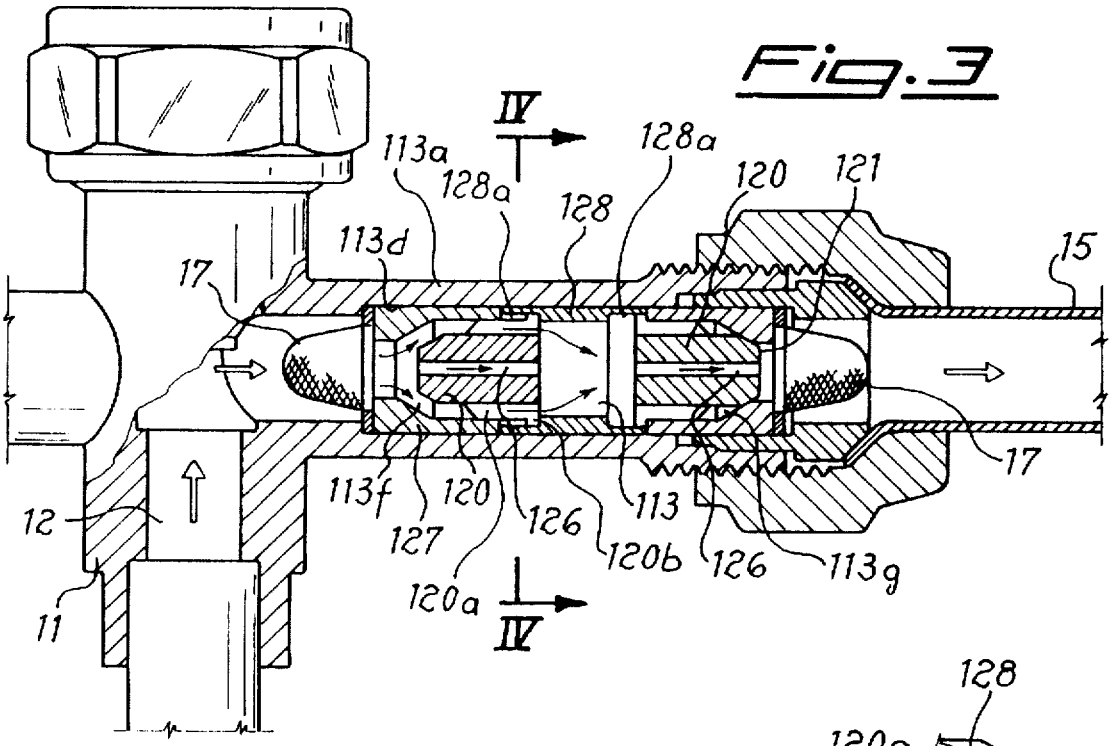
FIG. 3 shows a partially sectioned view of the valve according to the present invention with double-acting expansion means open for operation as an air conditioner.

As shown in FIGS. 1 and 2, the valve 10 according to the invention is of the three-way type and substantially consists of a body 11 which has formed inside it three ducts: 12 for delivery of the fluid from the condenser, 13 for coupling to the pipe 15 (FIG. 2) for connection to the evaporator (not illustrated), and 16 for insertion of an instrument **16*a* (FIG. 2**) for detecting and measuring the pressure of the liquid present inside the piping of the apparatus.

The valve is completed by an obturator 18 which can be operated by means of a spanner acting on an adjusting nut **18*a***.

The duct 13 is formed inside an outlet **13*a* with an external threading 13*b*. The outlet has inside it two coaxial seats, respectively 13*c* and 13*d*, for housing and receiving in abutment a filtering element 17 and a nozzle 20 retained in their seats by a nut 13*e* which can be tightened on the threading 13*b* of the outlet 13**.

The the nozzle 20 has an external surface formed with at least two conical surfaces 21 and 22 of opposite inclination, designed to ensure a seal respectively with the duct 13 of the valve body and the pipe 15 for connection to the evaporator.

On the external surface of the nozzle 20 there is also formed an annular groove 23 for partially containing an annular sealing gasket **23*a***.

The opposite front surfaces 24 and 25 of the nozzle have respective recessed seats **24*a*, 25*a* connected to one another by a capillary duct 26 coaxially formed inside the nozzle 20** and designed to cause the desired rapid expansion of the fluid prior to its transfer from the condenser to the evaporator.

Although a preferred three-way embodiment has been described, it is obvious, however, that the valve according to the invention may be realized also with a two-way valve if it were not required to take the measurement of the pressure value of the liquid by means of the instrument 18.

Figure 4:
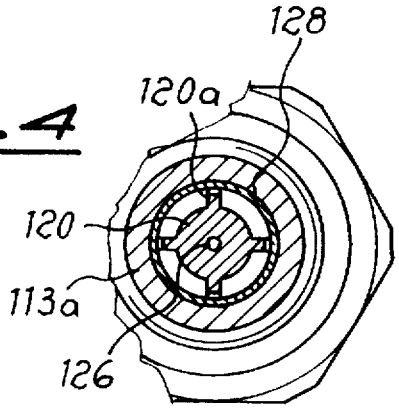
FIG. 4 shows a cross-section along the plane indicated by IV—IV in FIG. 3.
Figure 5:
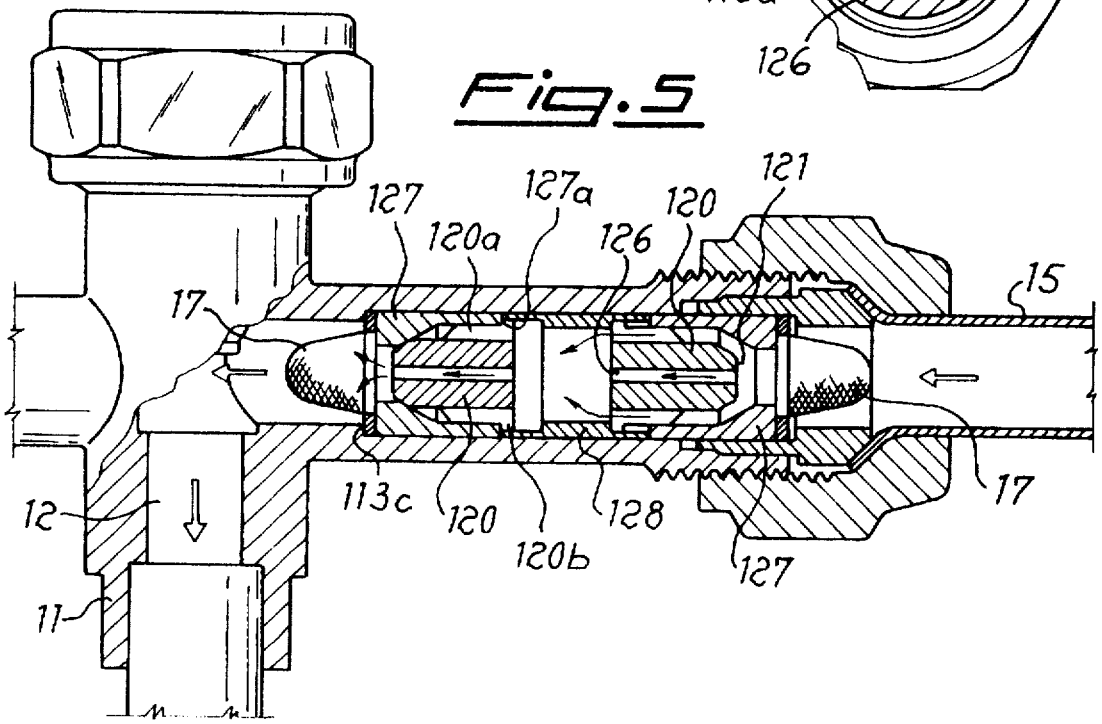
FIG. 5 shows a partially sectioned view of the valve according to the present invention with double-acting expansion means open for operation as a heat pump.

As illustrated in FIGS. 3, 4 and 5, the valve according to the invention may also be constructed with a double-acting expansion nozzle 120 for use in apparatus which functions both as an air conditioner and as a heat pump.

In this case, in fact, it is required that expansion should occur in one direction or the other.

In this embodiment it is envisaged that the outlet **113*a* should be elongated so as to form an internal duct 113 having a length such that it can contain two nozzles 120 which are identical to one another, but arranged opposite one another and movable in the axial direction along the duct 113** itself as will be specified more clearly below.

Each nozzle, however, has an axial capillary duct with a different gauge depending on the different expansion which it must perform.

More particularly, inside the duct 113 there is provided a seat 113*c* for the filter 17 and an additional seat 113*d* for housing a bush 127 which has coaxially inserted inside it the nozzle 120 which has a frustoconical anterior front, surface 121 for effecting the seal against the corresponding seat and a rear part provided with radial fins 120*a*, at the rear end of which there is formed a projection 120*b* designed to come into contact with the rear end 127*a* of the bush 127 and with a spacer 128 inserted in the said duct 113 and provided with an annular depression 128*a* which allows a limited degree of axial sliding of the nozzle 120.

As clearly illustrated in FIGS. 3 and 5, the two nozzles 120 and the other parts are arranged so as to form a perfect mirror-image. Consequently, during operation as an air conditioner (FIG. 3) where expansion of the fluid must occur during flowing of the fluid from the valve 10 to the pipe 15, the pressure of the fluid itself produces sliding to the right of both the nozzles 120, thus causing opening of the aperture 113*f* defined between the nozzle 120 and the bush 127 of the right-hand nozzle and closing of the aperture 113*g* defined between the bush 127 and the left-hand nozzle 120.

In this configuration, the fluid from the duct 12 of the valve 10 is able to flow freely until it encounters the left-hand nozzle where, in order to pass through it, it is necessarily channelled into the capillary 126 at the outlet of which the desired expansion occurs.

Operation occurs in exactly the same manner, but in the opposite direction, during operation of the apparatus as a heat pump illustrated in FIG. 5, in which it is the right-hand nozzle which is open and the left-hand nozzle which is closed.

Figure 6:
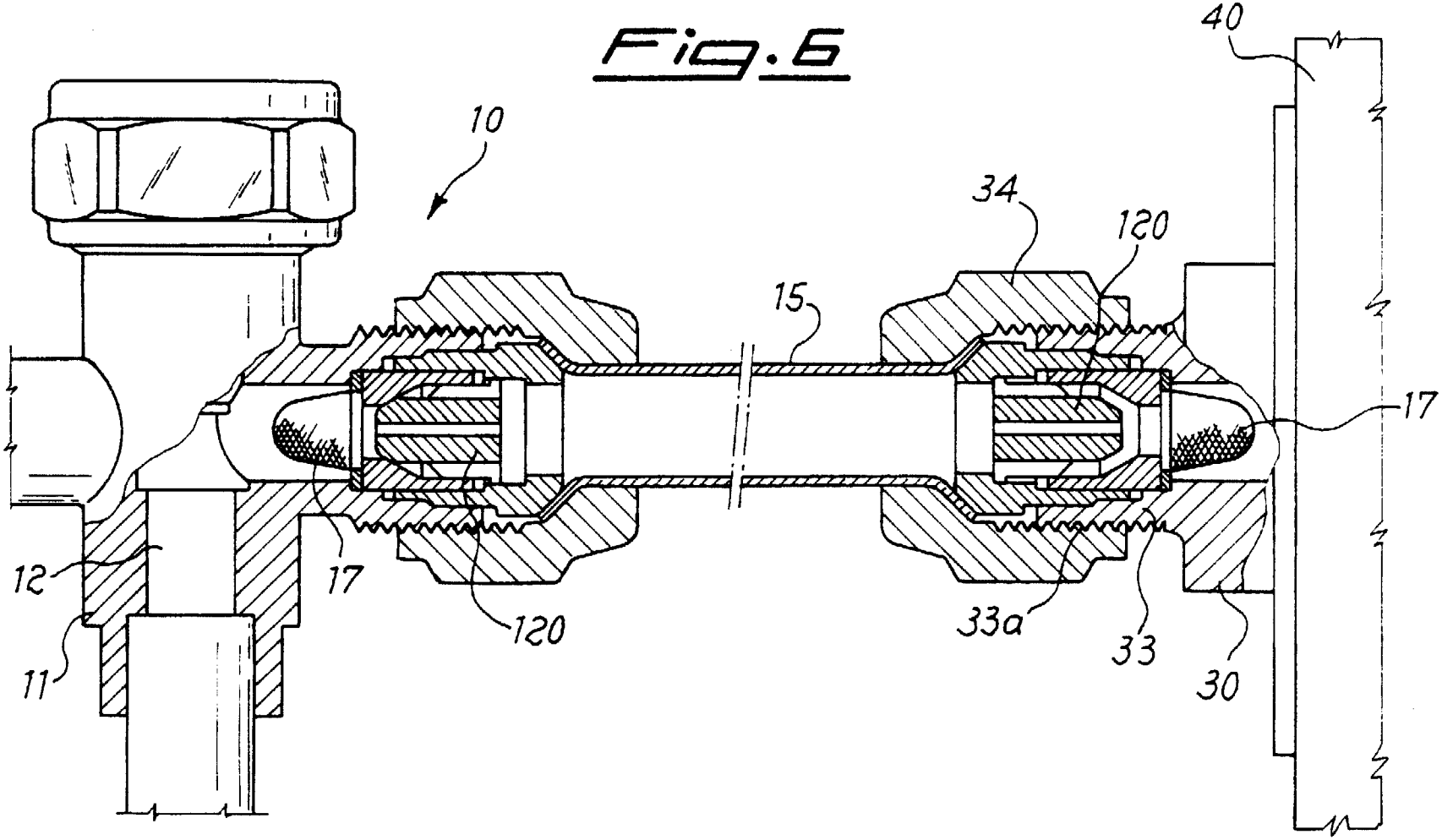
FIG. 6 shows a partially sectioned view of a variation of an example of embodiment of the valve with double-acting expansion means.

FIG. 6, finally, illustrates a variation of embodiment of the valve 10 with bidirectional expansion, in which the valve 10 has a configuration identical to that of FIG. 2 and is therefore not described further, while the second nozzle 120 is inserted inside the connector 30 fixed to the evaporator only schematically shown at 40.

The connector has a tubular section 33 with threading 33*a*, inside which the nozzle 120 is inserted as already described for FIGS. 3 and 5.

Finally the pipe 15 is inserted and is retained by the nut 34, causing the same operation described for FIGS. 3 and 5 already mentioned, but with greater standardization of component parts. In this case, in fact, the valve 10 may be remain unvaried with respect to the single-acting configuration according to FIG. 2.

Many variants may be introduced as regards the realization of the parts which make up the invention, without thereby departing from the protective scope of the present invention as defined by the claims which follow.

I claim:

1. A shut-off valve for a pressurized fluid in an air cooling/heating apparatus comprising at least one condenser and at least one fluid evaporator in communication with each other through a pipe, said valve comprising at least one duct receiving in said duct a nozzle coaxially formed with a capillary through which the fluid passes and which is designed to cause rapid expansion of the fluid when it emerges from the nozzle, said nozzle being held in position by means for securing the said pipe to the valve, said nozzle having two opposite inclined surfaces, one of said surfaces engaging a corresponding surface of the duct so as to provide a seal preventing passage of the fluid, the other of said surfaces engaging a flared end of said pipe, said means for securing being a flare-fitting nut threaded onto said valve.

2. The valve according to claim 1 said nozzle has a body provided with an annular seat for housing an annular sealing element.

3. The valve according to claim 1, wherein said duct has a seat for housing and receiving in abutment an element for filtering the fluid.

4. The valve according to claim 1, wherein said valve is a three-way valve.

5. The valve according to claim 1, which is of a two-way type.

6. A shut-off valve for an air-conditioning system, comprising:

a valve body formed with a first duct for receiving a pressure-measuring instrument, a second duct communicating with a condenser of an air-conditioning system, and a third duct connectable to an evaporator of the air-conditioning system;

a valve member in said body displaceable between a position in which flow between said second duct and said third duct is blocked and a position in which flow between said second duct and said third duct is permitted, said third duct having an externally threaded end;

a nozzle body received in said end and having at opposite ends conical surfaces of opposite inclination surrounding respective oppositely opening recesses, a capillary connecting said recesses and an outwardly open annular groove receiving a sealing gasket;

a nut threaded onto said externally threaded end of said third duct and clamping a flared end of a pipe connected to said evaporator directly against one of said conical surfaces of said nozzle body, the other of said conical surfaces directly engaging a shoulder in said externally threaded end.

* * * * *